US012466601B2

(12) United States Patent
Yourist

(10) Patent No.: US 12,466,601 B2
(45) Date of Patent: Nov. 11, 2025

(54) PLASTIC CONTAINER WITH CONTAINER STRUT SUPPORT COLUMNS

(71) Applicant: Graham Packaging Company, L.P., Lancaster, PA (US)

(72) Inventor: Sheldon E. Yourist, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 67 days.

(21) Appl. No.: 18/143,541

(22) Filed: May 4, 2023

(65) Prior Publication Data

US 2024/0367844 A1 Nov. 7, 2024

(51) Int. Cl.
*B65D 1/02* (2006.01)
*B65D 23/10* (2006.01)

(52) U.S. Cl.
CPC ..... *B65D 1/0207* (2013.01); *B65D 23/10* (2013.01); *B65D 2501/0027* (2013.01); *B65D 2501/0036* (2013.01); *B65D 2501/0045* (2013.01); *B65D 2501/0081* (2013.01)

(58) Field of Classification Search
CPC ..... B65D 1/0207; B65D 1/44; B65D 23/10; B65D 2501/0027; B65D 2501/0036; B65D 2501/0045; B65D 2501/0081
See application file for complete search history.

(56) References Cited

U.S. PATENT DOCUMENTS 3,335,902 A * 8/1967 Javorik ..... B65D 7/46 D9/551
5,690,244 A 11/1997 Darr
6,095,360 A 8/2000 Shmagin et al.
6,161,713 A * 12/2000 Krich ..... B65D 1/44 215/382
6,213,326 B1 4/2001 Denner et al.
6,273,282 B1 8/2001 Ogg et al.
6,390,316 B1 5/2002 Mooney
6,439,413 B1 8/2002 Prevot et al.
(Continued)

FOREIGN PATENT DOCUMENTS

AU 2013370421 B2 9/2017

OTHER PUBLICATIONS

Collins Dictionary Definition for "Diameter" (Year: 2025).*

*Primary Examiner* — Andrew T Kirsch
(74) *Attorney, Agent, or Firm* — Armstrong Teasdale LLP

(57) ABSTRACT

A plastic container including a top container portion having a plurality of spaced top strut members, a bottom container portion having a plurality of spaced bottom strut members, and a middle container portion located between the top and bottom container portions. The top, bottom and middle container portions oriented along a container axis. The middle container portion includes a plurality of annular rib members each rib member being separated from longitudinally adjacent rib members by an annular groove, each groove having a number of middle strut members disposed along a length of the groove, adjacent middle strut members of adjacent grooves being longitudinally aligned. Each container portion comprises a plurality of first columns comprised collectively of a top strut member, middle strut members and a bottom strut member the top strut member, middle strut members and bottom strut member comprising each of the first columns are longitudinally aligned.

18 Claims, 16 Drawing Sheets

(56) References Cited

U.S. PATENT DOCUMENTS

| | | | | |
|---|---|---|---|---|
| 6,796,450 | B2 | 9/2004 | Prevot et al. | |
| 6,923,334 | B2 | 8/2005 | Melrose et al. | |
| 7,159,729 | B2 | 1/2007 | Sabold et al. | |
| 7,172,087 | B1 | 2/2007 | Axe et al. | |
| 7,198,164 | B2 | 4/2007 | Yourist et al. | |
| 7,604,140 | B2 | 10/2009 | Pritchett, Jr. et al. | |
| 7,810,664 | B2 | 10/2010 | Trude | |
| 7,823,737 | B2 | 11/2010 | Noll et al. | |
| 7,832,583 | B2 | 11/2010 | Ungrady et al. | |
| 8,087,525 | B2 | 1/2012 | Kelley et al. | |
| 8,109,398 | B2 | 2/2012 | Lewis et al. | |
| 8,281,953 | B2 | 10/2012 | Yourist | |
| 8,459,479 | B2 | 6/2013 | Yourist | |
| 8,561,822 | B2 | 10/2013 | Beck et al. | |
| 8,567,622 | B2 | 10/2013 | Yourist et al. | |
| 8,567,623 | B2 | 10/2013 | Shah et al. | |
| 8,863,970 | B2 | 10/2014 | Hunter | |
| 9,162,807 | B2 | 10/2015 | Melrose et al. | |
| 9,174,770 | B2 | 11/2015 | Yourist et al. | |
| 9,707,711 | B2 | 7/2017 | Trude et al. | |
| 10,053,275 | B2 | 8/2018 | Pritchett et al. | |
| 10,183,779 | B2 | 1/2019 | Yourist | |
| 10,189,596 | B2 | 1/2019 | Wurster et al. | |
| 10,336,503 | B2 | 7/2019 | Yourist et al. | |
| 11,001,404 | B2 | 5/2021 | Denner et al. | |
| 11,136,159 | B2 | 10/2021 | Waltemyer et al. | |
| 2010/0270259 | A1 | 10/2010 | Russell et al. | |
| 2011/0132863 | A1* | 6/2011 | Dorn ..... | B65D 1/0223 215/10 |
| 2011/0226787 | A1 | 9/2011 | Yourist | |
| 2015/0076163 | A1 | 3/2015 | Yourist | |
| 2021/0130031 | A1 | 5/2021 | Yourist et al. | |

* cited by examiner

PLASTIC CONTAINER WITH CONTAINER STRUT SUPPORT COLUMNS

FIELD OF THE DISCLOSURE

The field of the disclosure generally relates to blow-molded plastic containers and more specifically to blow-molded plastic containers having support columns for resisting container deformation.

BACKGROUND

Plastic containers, such as plastic bottles are frequently manufactured in large volumes. A blow-molding process may be used to effectively meet high volume container production targets. Generally, in a blow-molding operation, a volume of material, referred to as a parison, is supplied to a mold cavity. The parison may comprise a high density polyethylene (HDPE). During the blow-molding process, pressurized air is supplied into the mold cavity and into the parison. The pressurized air causes the softened parison material to expand outwardly to match the shape of the mold, and thereby form a hollow container of the desired shape. After the blow-molding process is completed, the hollow container is ejected from the mold cavity and transferred away from the blow-molding machine. The newly manufactured container cools as it travels away from the blow-molding station to a container storage location As the containers approach the storage location they are collected on a pallet with the base of each container located on the pallet and the containers oriented perpendicular to the pallet surface. A first layer of containers are located on the pallet, with the containers densely packed on the pallet surface, and each container being in contact with a number of adjacent containers. A slip sheet is then positioned over the first layer of containers. A second layer of containers is then developed on the slip sheet. A second slip sheet may then be positioned over the second layer of containers followed by the development of a third layer of containers. Because the dimensions of the containers are substantially the same, the upper ends of the densely packed containers are located in a plane and as a result collectively serve to support a second pallet that is located directly on the upper container ends.

Once the pallet is fully loaded it is shrink-wrapped, and a second shrink-wrapped pallet is stacked vertically on the upper ends of the containers on the previously loaded pallet. The second pallet is supported by the containers when the pallet is placed on the container free upper ends. The containers are structurally designed to resist deformation as a result of the weight of additional layers of stacked containers and the containers of the second pallet, with a bottom-most layer of containers realizing the greatest magnitude forces exerted on the containers. The axial loading realized by the containers supporting the second pallet increases as the blow-molded containers are located on the second pallet, once the second pallet is fully loaded. Once the load of containers to be shipped is complete, the pallets are secured for shipment to a customer.

In order for the containers to effectively support the weight of the pallets and other containers, the containers must possess the structural attributes necessary to ensure that the integrity of the containers is maintained during their shipment, so that the containers are able to be filled or otherwise used by the customer upon their arrival. Frequently, in order to ensure that the containers resist deformation during shipment, the containers are designed with an increased wall thickness. In addition to increasing the container wall thickness, the containers strength may be further enhanced by the inclusion of additional wall thickness comprising structural members provided along the exterior container wall. The additional plastic material required to enable the containers to prevent container deformation during shipment increases the weight of each container, the cost to manufacture each container as well as the associated shipping costs of the heavier containers. The use of additional plastic in known containers serves to impede improving sustainability of plastic blow-molded containers. Therefore there is a need for a container that resists deformation during shipment and storage and is manufactured using less plastic than is used in known containers of similar volume.

SUMMARY

In one aspect, a blow-molded plastic container is disclosed. A plastic container including a top container portion having a plurality of spaced top strut members, a bottom container portion having a plurality of spaced bottom strut members, and a middle container portion located between the top and bottom container portions. The top, bottom and middle container portions oriented along a container axis. The middle container portion includes a plurality of annular rib members, each rib member being separated from longitudinally adjacent rib members by an annular groove, each groove having a number of middle strut members disposed along a length of the groove, adjacent middle strut members of adjacent grooves being longitudinally aligned. Each container portion comprises a plurality of first columns comprised collectively of a top strut member, middle strut members and a bottom strut member. The top strut member, middle strut members and bottom strut member comprising each of the first columns are longitudinally aligned.

BRIEF DESCRIPTION OF THE DRAWINGS

Features and aspects of embodiments are described below with reference to the accompanying drawings, in which elements are not necessarily depicted to scale. Corresponding reference characters indicate corresponding parts throughout the several views of the drawings.

Exemplary embodiments of the present disclosure are further described with reference to the provided figures. It is to be noted that the various features, steps and combinations of features/steps described below and illustrated in the figures can be arranged differently to result in embodiments which are still within the scope of the present disclosure.

DETAILED DESCRIPTION

Figure 1:
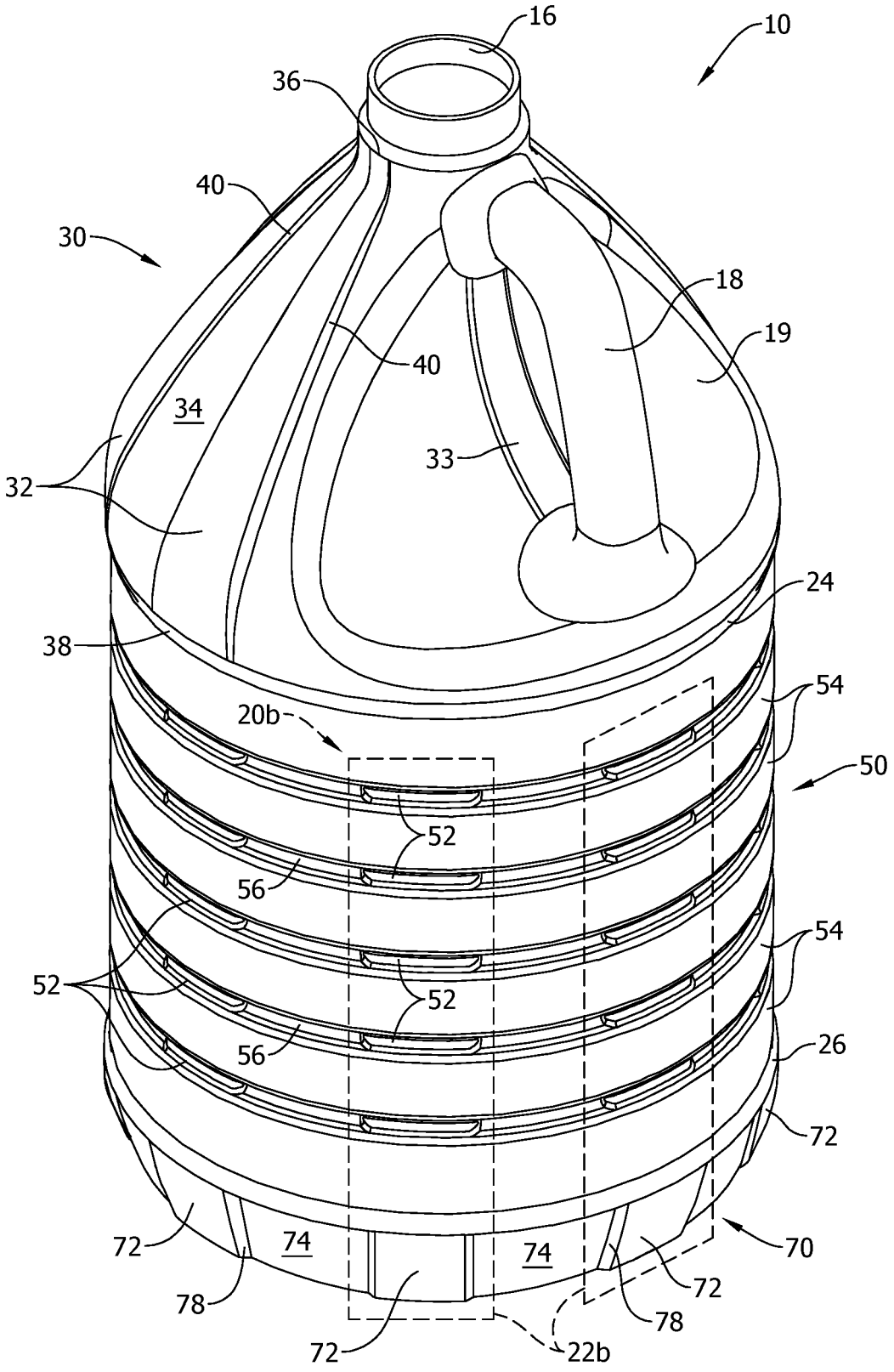
FIG. 1 is a first embodiment container in accordance with embodiments of the present disclosure.

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" means that the subsequently described event or circumstance may or may not occur, and that the description includes instances where the event occurs and instances where it does not.

As used herein, the term "container" refers to any hollow vessel that can support a volume of liquid, and where the container has a closed base, an opening along the top of the container and middle portion extending between the opening in the top and closed bottom. More specifically, a container may comprise a blow-molded bottle suitable to liquid containers made by extrusion blow-molding.

A first embodiment container 10 of the present disclosure is shown in FIGS. 1-10. The container 10 generally comprises a container that is lighter than other similarly dimensioned containers and possesses strut columns 20 that enable the lighter container 10 to resist deformation during container shipping or storage. For purposes of the description of the present disclosure the container 10 may comprise a plastic blow-molded bottle.

Container 10 comprises a top container portion 30, a bottom container portion 50, and a middle container portion 70 located between the top and bottom portions 30 and 50 respectively. As shown in FIGS. 3, 4, 5 and 7 the container middle and bottom portions 50 and 70 have a circular lateral cross-section and the portions 50 and 70 in combination define a cylindrical container body. The top container portion 30 is frusto-conical, and tapers inward as the top portion 30 extends longitudinally from the middle portion 50 to container opening 16. A recess 19 is provided in the frustoconical top container portion 30 to accommodate a generally L-shaped container handle 18 integral with the top portion 30. The handle extends from a location along the top portion 30 proximate opening 16 to a location along the top portion proximate middle container portion 50. In combination, the top, bottom and middle portions 30, 50, 70 define a hollow container interior 12 that holds a volume of a liquid.

As used herein, the term "longitudinal" denotes a plane or axis extending between the top container portion 30 and the bottom container portion 70, and the term "lateral" denotes a plane or axis transverse to the longitudinal axis. The container 10 is substantially symmetrical along the longitudinal axis, and the support columns 20*a* and 20*b* oriented longitudinally.

Figure 2:
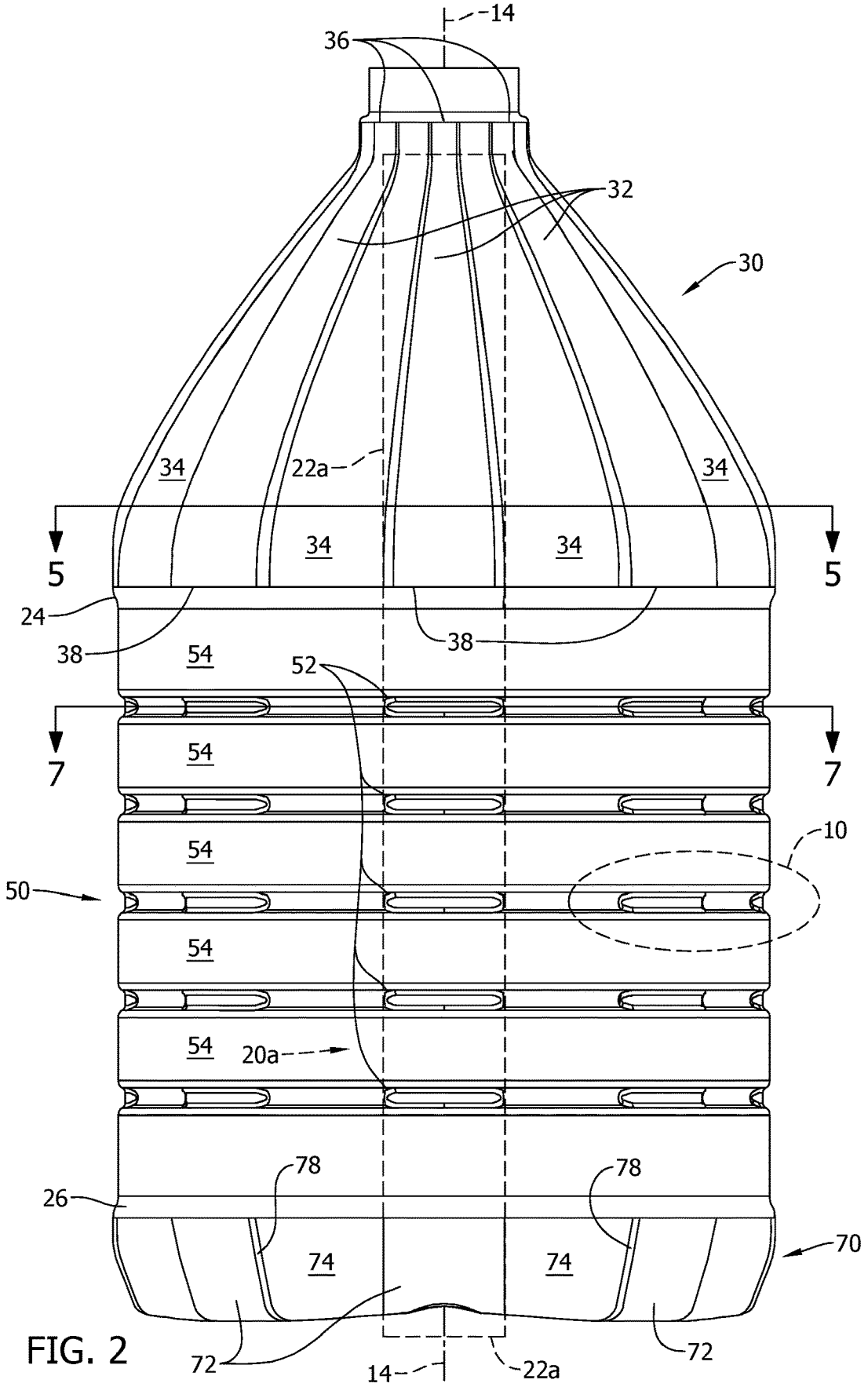
FIG. 2 is a front view of the container of FIG. 1 in accordance with embodiments of the present disclosure.
Figure 9:
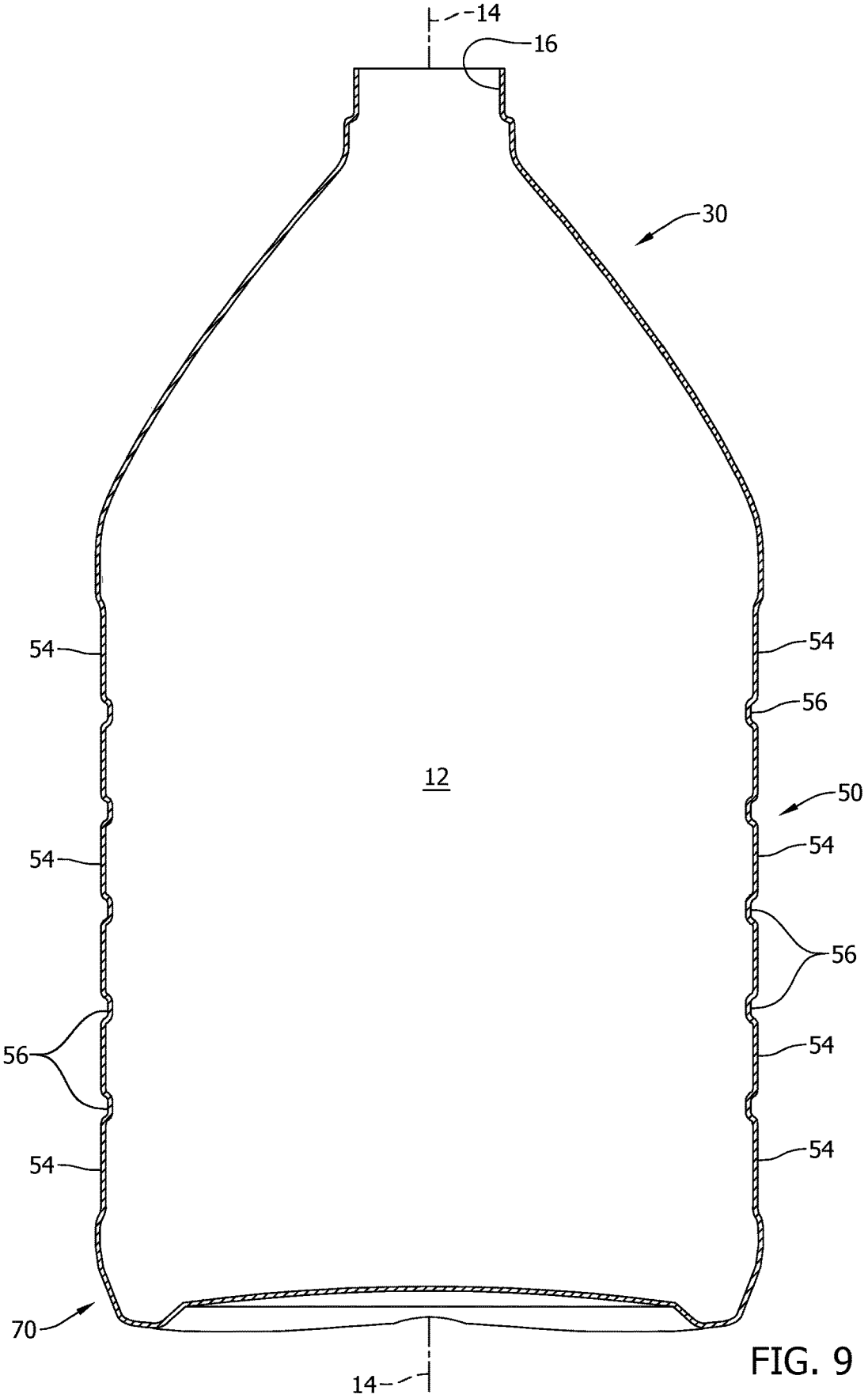
FIG. 9 is a longitudinal sectional view taken along line 9-9 in FIG. 3 in accordance with embodiments of the present disclosure.
Figure 10:
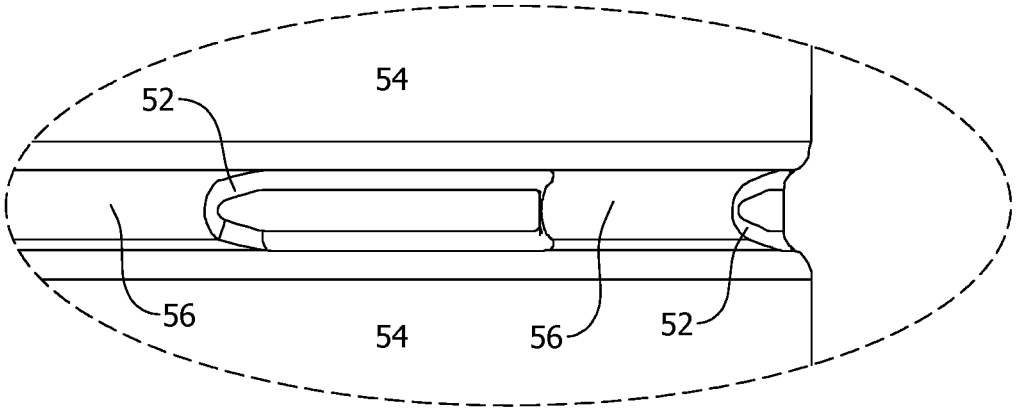
FIG. 10 is a detailed view of a portion of the container located within the oval identified as detail 10 in FIG. 2 in accordance with embodiments of the present disclosure.

As shown in FIGS. 2 and 9, the top portion 30, the middle portion 50 and bottom portion 70 are oriented coaxially relative to the container longitudinal axis 14. The container 10 may be of unitary construction and may be made from any suitable material comprising, but not limited to high density polyethylene (HDPE) or polypropylene. The container may be made using a conventional blow-molding process including, for example, an extrusion blow-molding process. The container 10 may comprise any volumetric capacity including a 128-ounce US gallon (3.78 L) or a 64-ounce US half gallon (1.89 L) or any volumetric capacity therebetween.

As will be described in further detail below, the container includes a number of longitudinally extending support columns 20*a* and 20*b* See FIGS. 1 and 2. Hereinbelow, support column 20*a*, is referred to as a first column, and support column 20*b*, is referred to as a second support column. The first support column 20*a*, and second support column 20*b* are respectively and generally represented by respective dashed font rectangles 22*a*, 22*b*. See FIGS. 1 and 2.

Each column 20*a* collectively includes a combination of discrete strut members 32, 52 and 72 along the top, middle and bottom container portions respectively, and each column 20*b*, includes discrete strut members 52 and 72. Because columns 20*b*, are located below the recess 19 of the top portion 30, the columns 20*b* only include struts 52 and 72 since struts 32 are not included along the recessed top portion. As illustrated in FIGS. 1 and 2, the strut members 32, 52, and 72 of strut discrete columns 20*a*, and the strut members 52, 72 of discrete columns 20*b* are aligned longitudinally. The container 10 may include any suitable number of support columns 20*a*, 20*b*. For purposes of the present disclosure, container 10 shown in the figures includes eight total support columns comprised of a combination of columns 20*a* and 20*b*, however it is understood that the container may include any number of total support columns.

Figure 3:
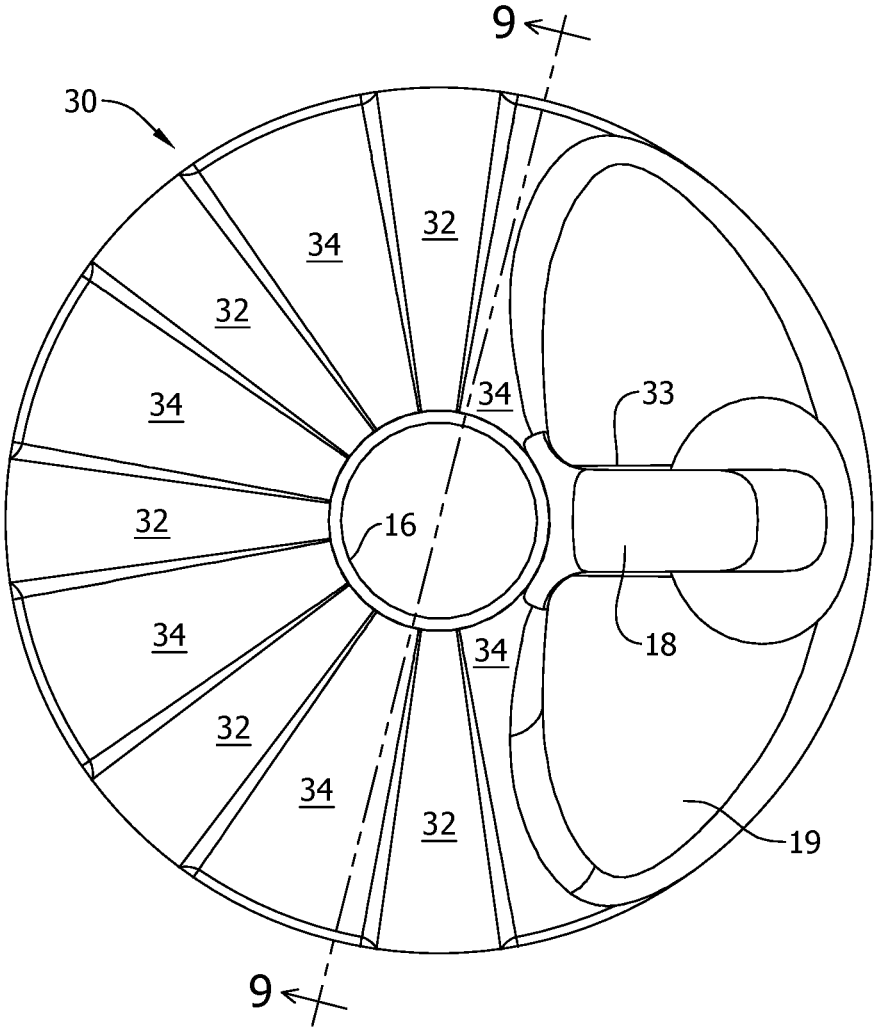
FIG. 3 is a top view of the container of FIG. 1 in accordance with embodiments of the present disclosure.
Figure 5:
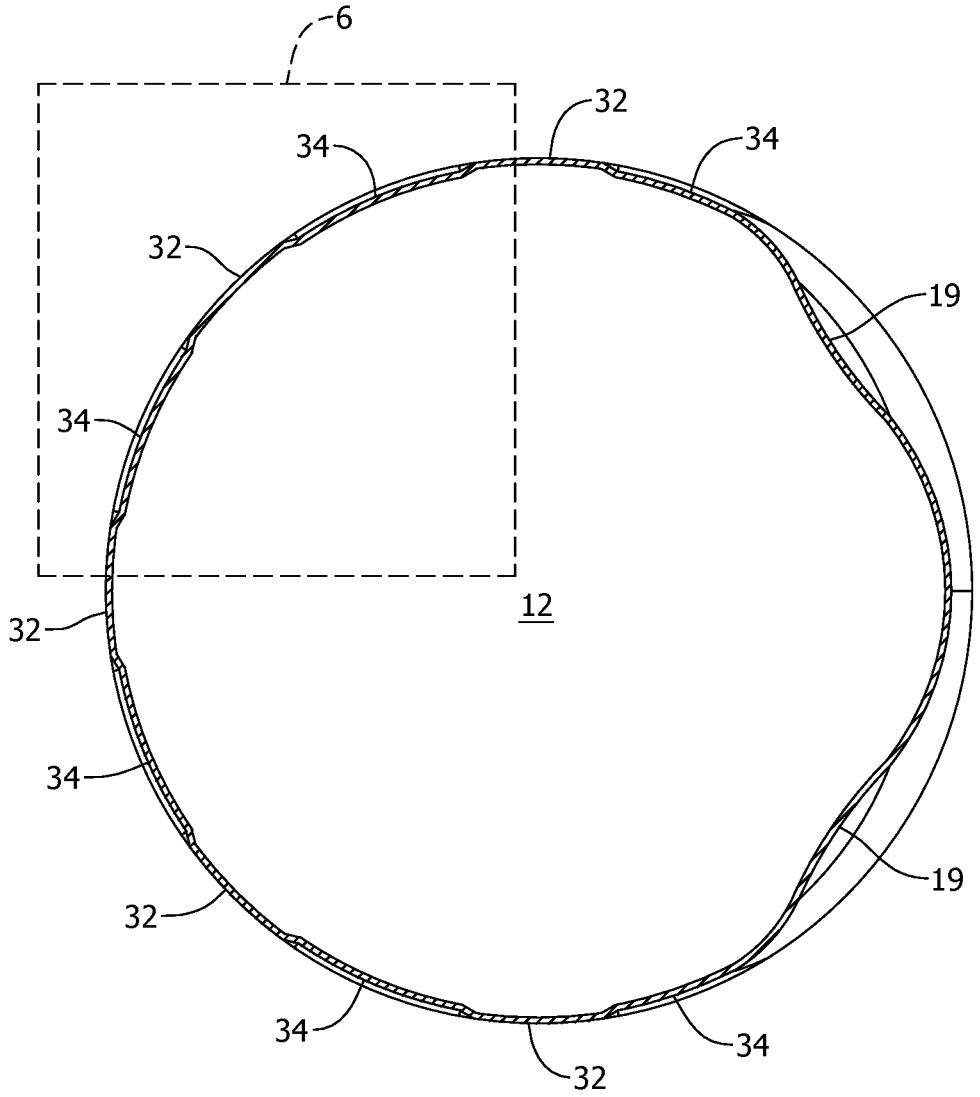
FIG. 5 is a lateral sectional view taken along line 5-5 in FIG. 1 in accordance with embodiments of the present disclosure.
Figure 6:
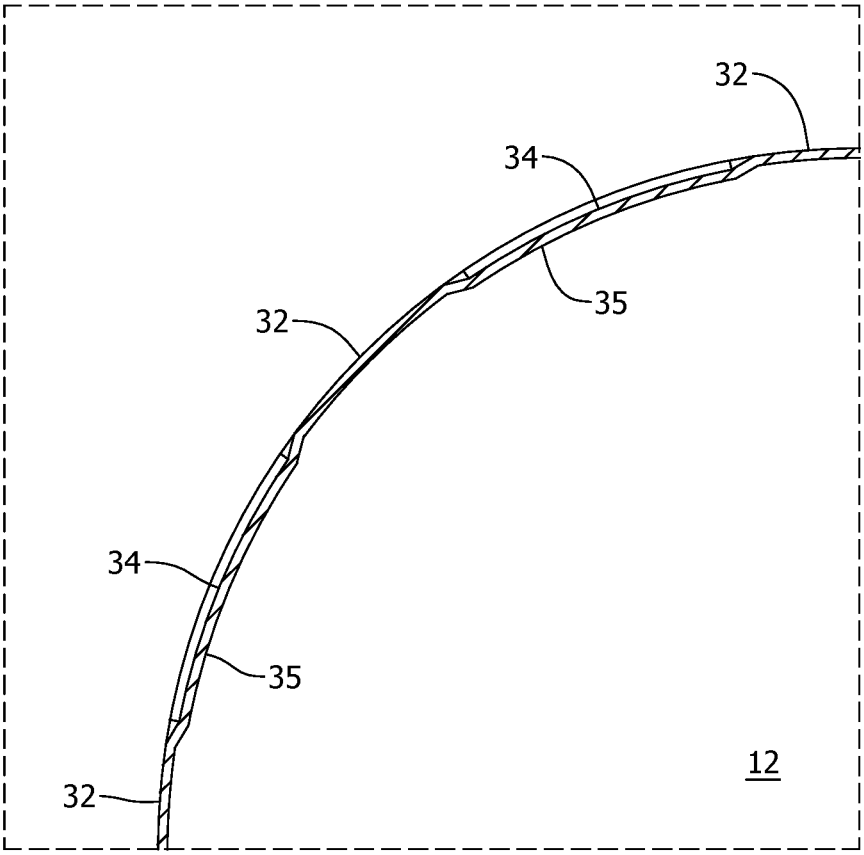
FIG. 6 is a detailed view of the portion of the sectional view of FIG. 5 located within the rectangle identified as detail 6 in FIG. 5 in accordance with embodiments of the present disclosure.
Figure 7:
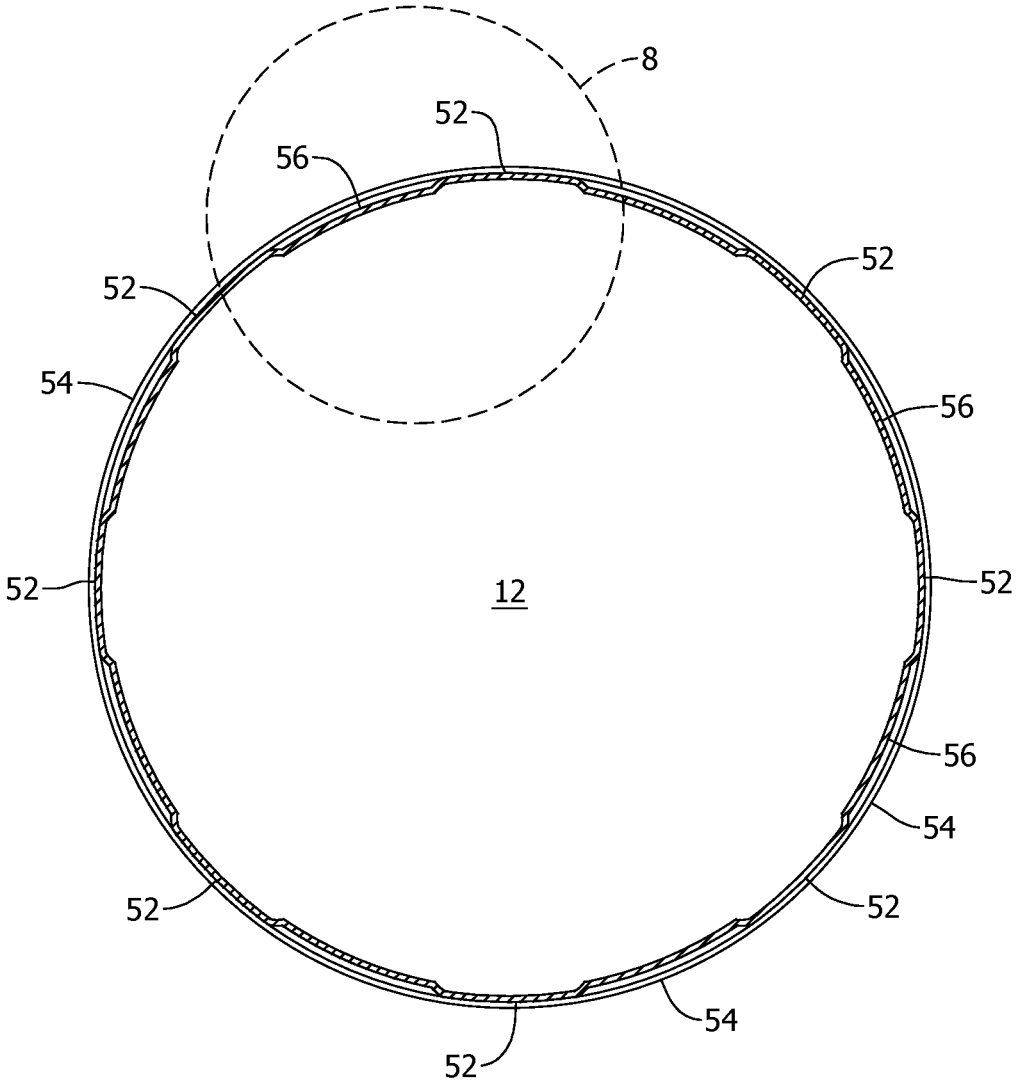
FIG. 7 is a lateral sectional view taken along line 7-7 in FIG. 1 in accordance with embodiments of the present disclosure.
Figure 8:
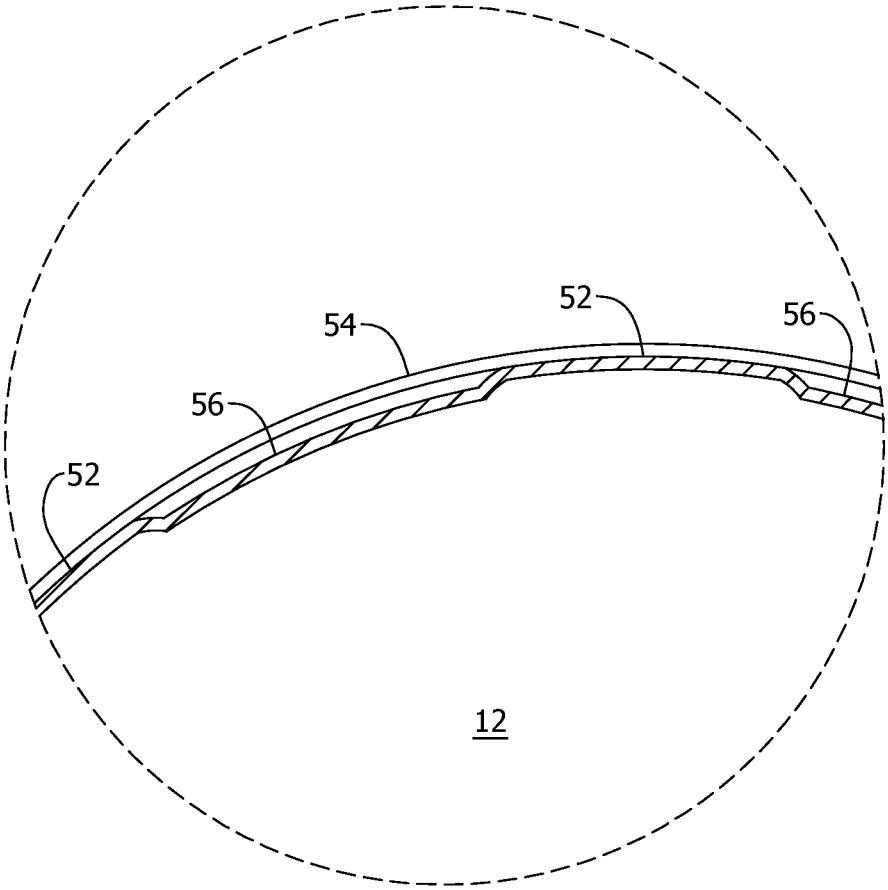
FIG. 8 is a detailed view of the portion of the sectional view of FIG. 7 located with the circle identified as detail 8 in FIG. 7 in accordance with embodiments of the present disclosure.

The support columns 20*a*, 20*b* enable the structure of the container 10 to have less material, thereby reducing the amount of plastic required to manufacture the container and also maintain the container strength required to absorb axial loading sustained by the container 10 when the container 10 is stacked under other boxed or palletized containers during container storage or transportation. Thus, the container 10 of the present disclosure comprises a lighter, environmentally sustainable vessel that is able to resist deformation and have greater axial loads relative to a conventional vessel having a similar volumetric capacity.—in a packed/stacked shape The container top portion 30 includes any number of strut members 32. Adjacent strut members 32 are separated by recessed portions 34 to create a circumferentially alternating arrangement of struts 32 and recessed portions 34 as shown in FIG. 3 and FIG. 7. The top strut members 32 are wedge-shaped as they extend longitudinally and comprise a first end 36 proximate opening 16 and a second end 38 proximate the middle container portion 50. The length of the second end 38 of the top strut 32 is greater than the length of first end 36, and as a result, the width of the top strut member 32 increases as the strut 32 extends radially from the first end 36 to the second end 38 to yield the longitudinal wedge shape of the top strut 32. The mold used to manufacture the container 10 during the blow-molding process includes a mold structure that produces the recessed portions 34 along the container exterior and the recessed portions 35 along the interior directed surfaces of top struts 32 as shown in FIGS. 5 and 6. As a result each strut 32 has a resulting substantially uniform thickness 40. The recessed portions 34 and 35 result in added rigidity and structure to the container 10 that is lighter than similar volume containers.

The middle container portion 50 comprises a plurality of annular rib members 54, that are spaced longitudinally between the top container portion 30 and bottom container portion 70. The annular rib members comprise a diameter that is less than the diameters associated with the top portion 30 and the bottom portion 70 where the top and bottom portions are made integral with the middle portion 50. Annular upper and lower shoulders 24 and 26 serve to effectively provide the transition from the relatively larger diameters of the top and bottom container portions to the reduced diameters of the rib members 54 of the middle container portion 50. The recessed middle portion 50 enables a label to be applied around the middle portion 50 identifying the contents of the container.

Each pair of longitudinally adjacent ribs 54 is separated by a U-shaped annular groove 56, as shown in FIG. 9. A plurality of discrete middle strut members 52 are disposed in each of the grooves 56. Each of the middle strut members 52 is spaced from a circumferentially adjacent middle strut member 52 by a segment of the annular groove. Any suitable number of middle strut members 52 may be disposed in each groove. The middle strut members 52 of each of the pair of longitudinally adjacent ribs 54 are aligned vertically and each of the adjacent ribs 54 comprising a support column 20*a*, 20*b* are aligned vertically.

For purposes of describing the first embodiment of the present disclosure, eight middle strut members are disposed in each groove 56. As shown in FIGS. 1 and 2, the middle strut members 52 are disposed in each of the grooves 56 in substantially the same circumferential position along the groove 56. As a result, the discrete middle strut members 52 located at substantially the same specific circumferential position along the groove are aligned along the longitudinal axis 14 and serve to form the middle strut comprised portion of respective support column 20*a* or 20*b*.

Figure 4:
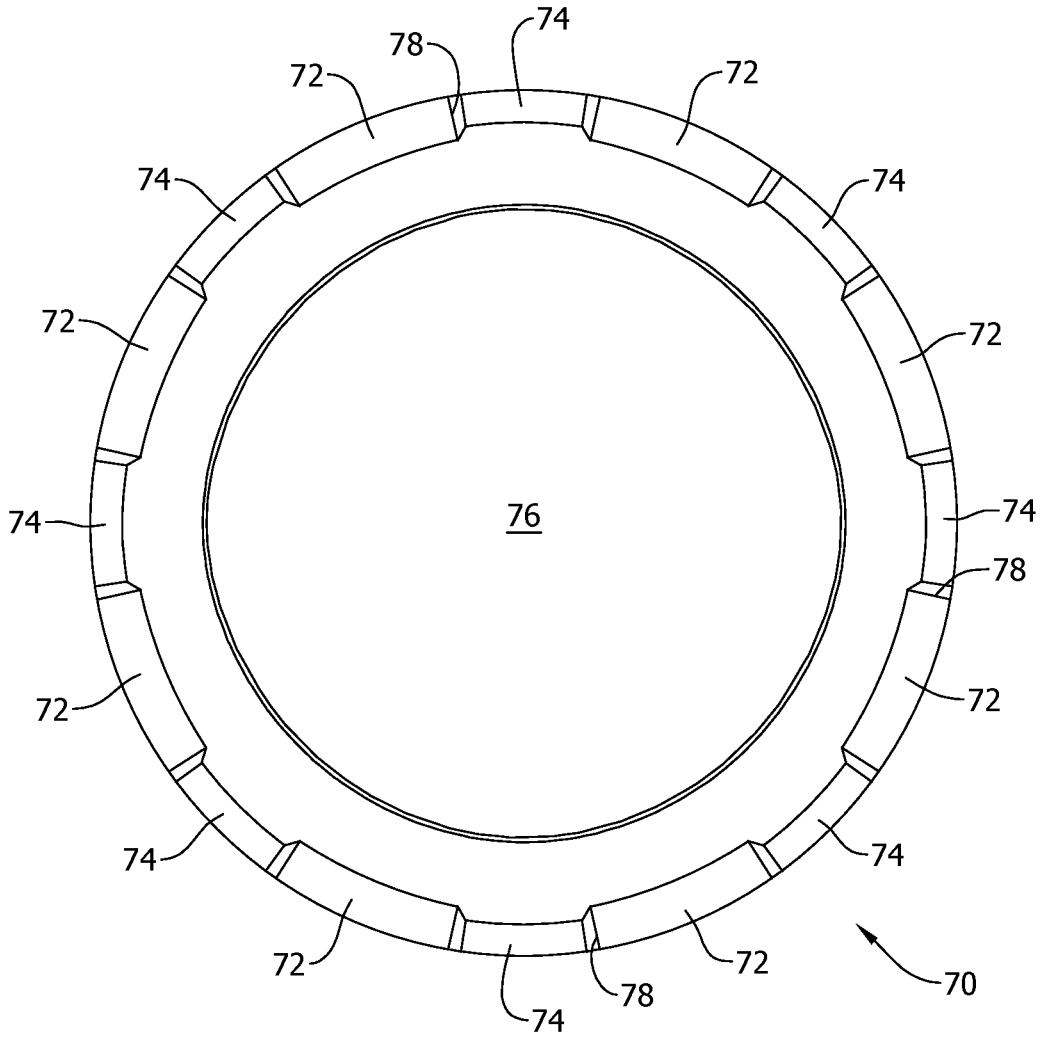
FIG. 4 is a bottom view of the container of FIG. 1 in accordance with embodiments of the present disclosure.

FIG. 4 illustrates the bottom container portion 70. The bottom container portion 70 includes a plurality of bottom strut members 72. During a blow-molding process a plurality of recesses 74 are formed in the container bottom 70. The bottom container portion 70 comprises a circumferential array of alternating bottom struts 72 and bottom recesses 74. The alternating bottom recesses 74 and bottom struts 72 are also shown in FIGS. 1 and 2. Each bottom strut 72 has the substantially constant lateral dimension as the bottom strut members extend longitudinally from the middle portion 50 to the closed bottom end 76. Each of the bottom strut members is longitudinally aligned with a top strut member and a plurality of middle strut members to form the column 20*a*. Alternatively, a plurality of middle strut members 52 may be longitudinally aligned with a bottom strut member to define a second column 20*b*.

The combination of the recessed portions 74, 34 and 35 as well as grooves 56 yield a container that may be up to 15% lighter than a container having similar volume. The columns 20*a*, 20*b* of the container 10 enables the container 10 to resist deformation during transportation and shipment.

Figure 11:
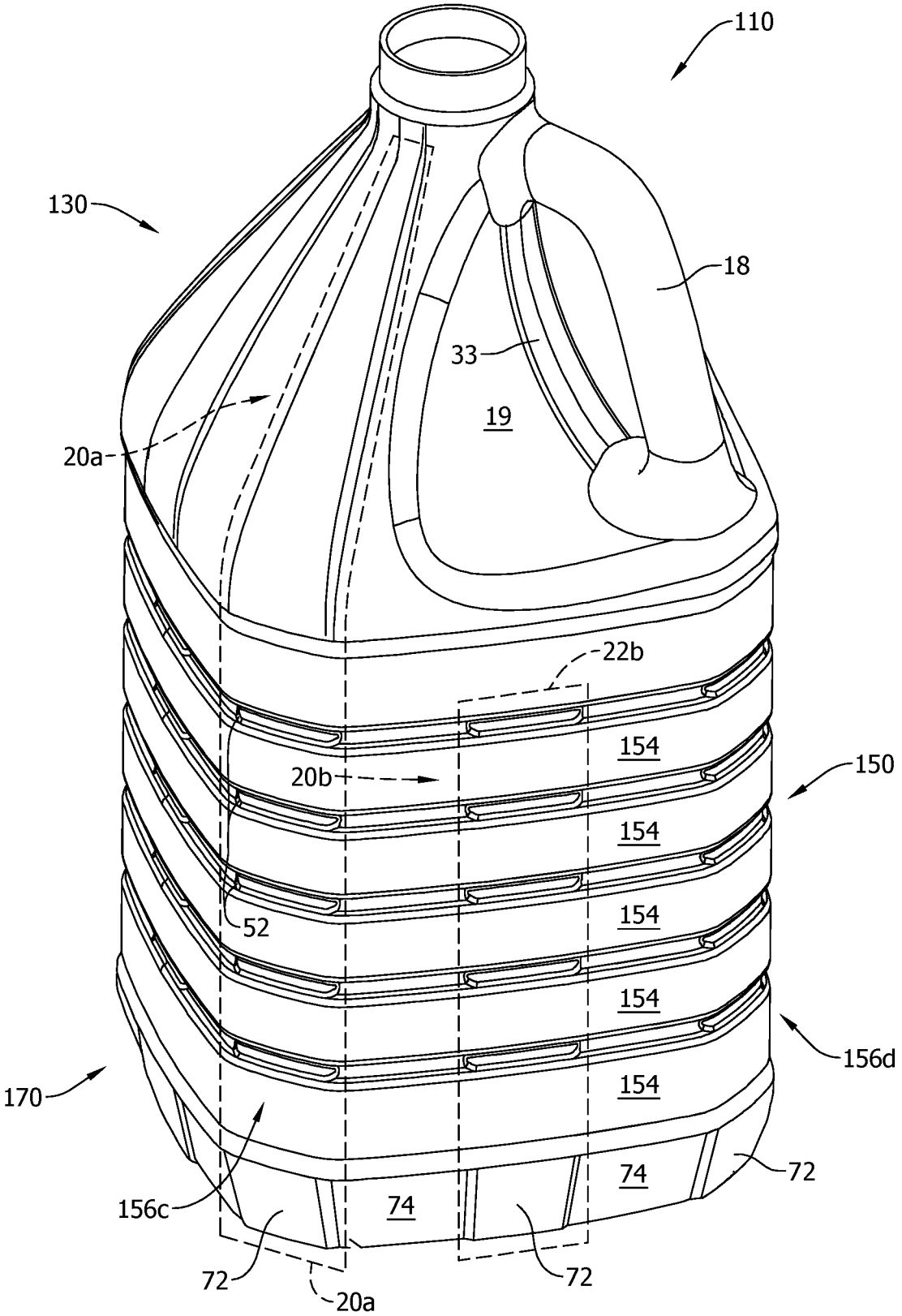
FIG. 11 is a perspective view of a second embodiment container in accordance with embodiments of the present disclosure.
Figure 12:
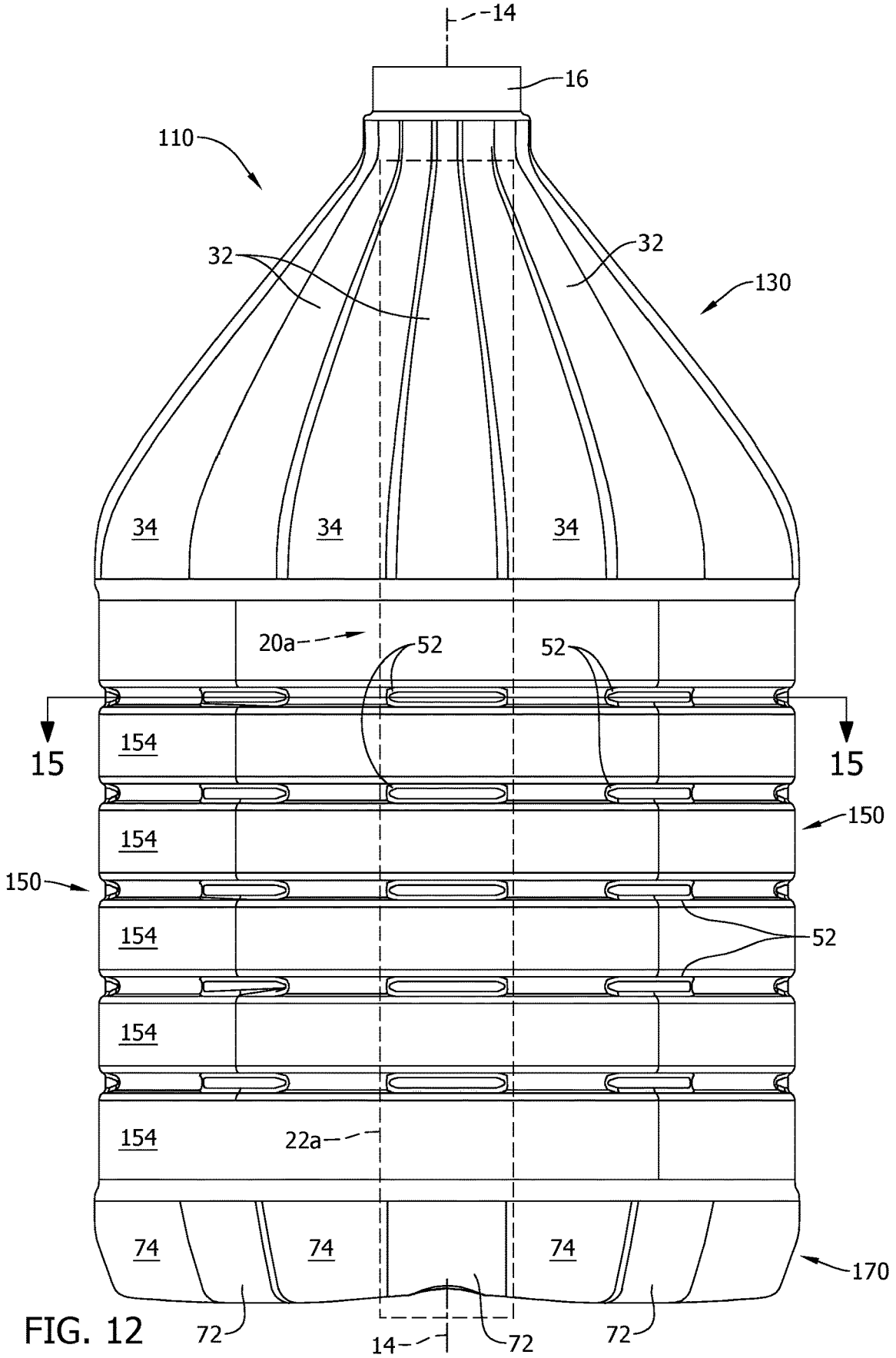
FIG. 12 is a front view of the container of FIG. 11 in accordance with embodiments of the present disclosure.
Figure 13:
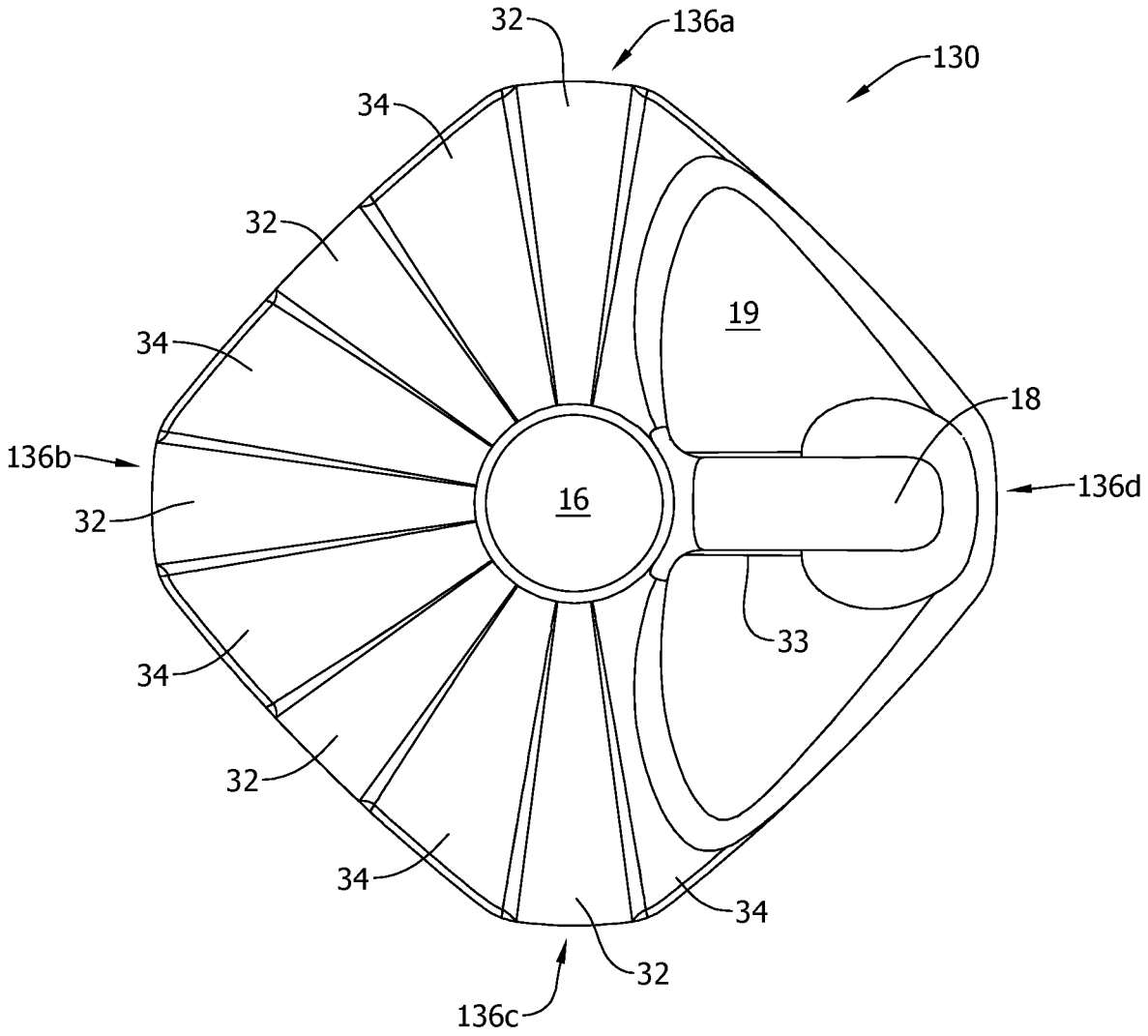
FIG. 13 is a top view of the container of FIG. 11 in accordance with embodiments of the present disclosure.
Figure 14:
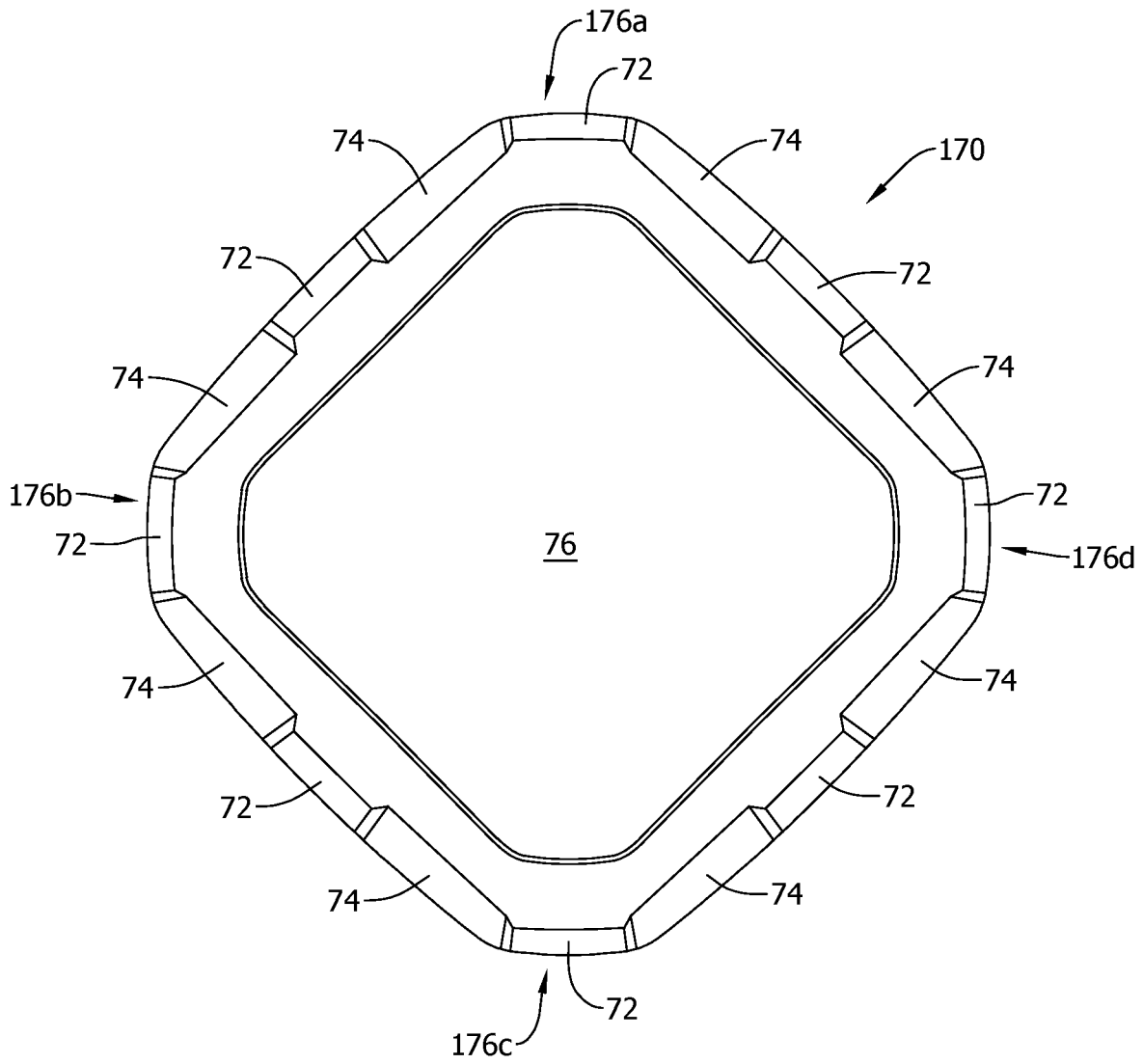
FIG. 14 is a bottom view of the container of FIG. 1 in accordance with embodiments of the present disclosure.
Figure 15:
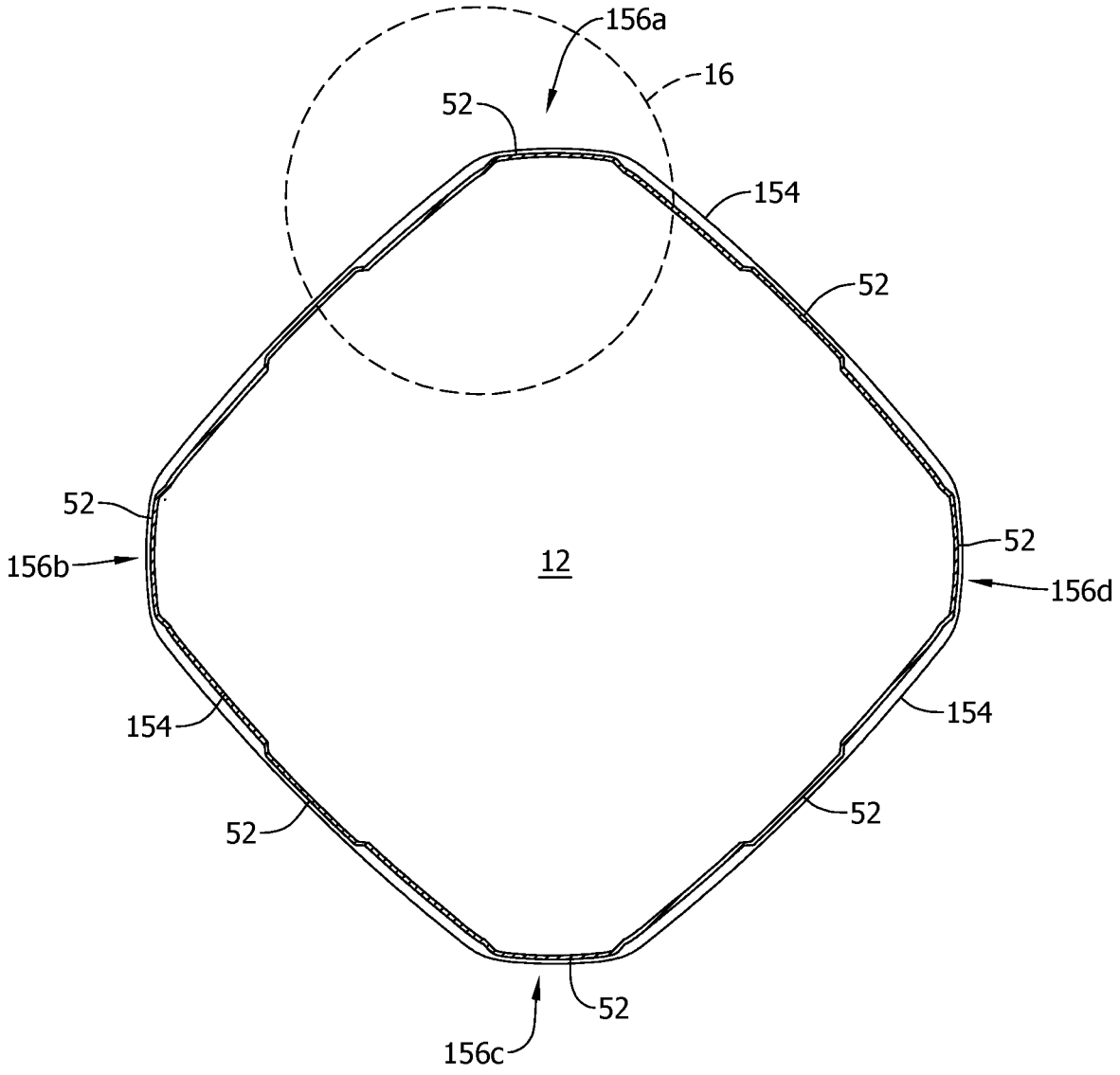
FIG. 15 is a lateral sectional view taken along line 15-15 in FIG. 11 in accordance with embodiments of the present disclosure; and, FIG. 16 is a detailed view of the portion of the sectional view of FIG. 5 located within the rectangle identified as detail 16 in FIG. 15 in accordance with embodiments of the present disclosure.
Figure 16:
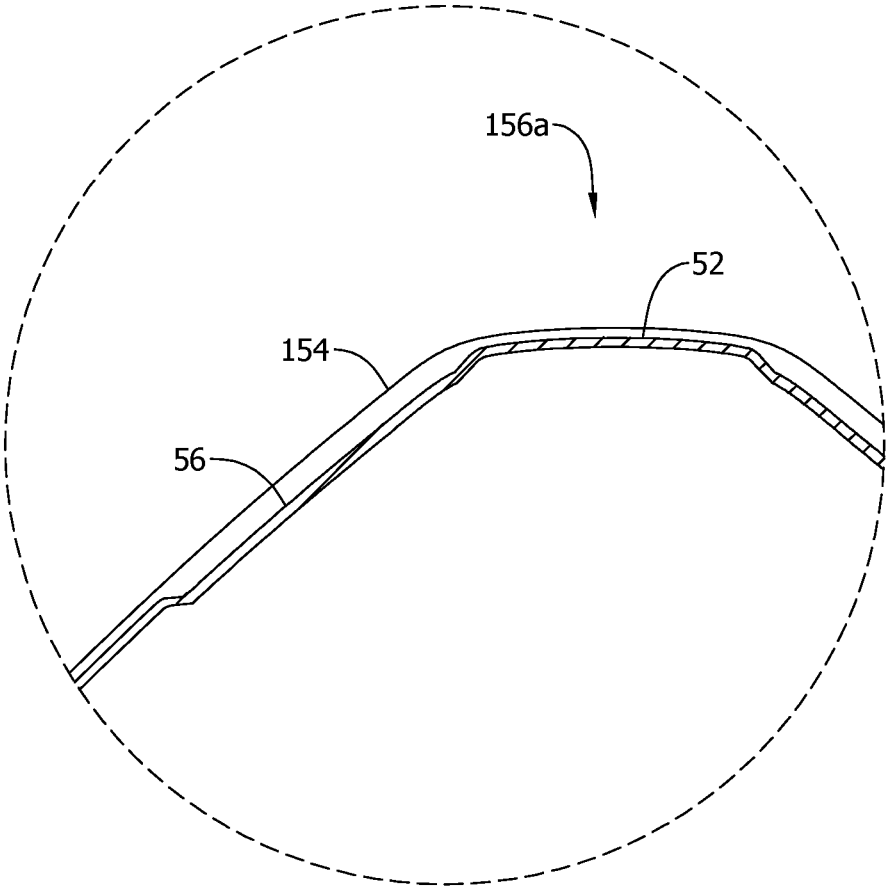

A second embodiment container 110 of the present disclosure is shown in FIGS. 11-16. The second embodiment container 110 includes top container portion 130, bottom container portion 170 and middle container portion 150 that is made integral with the top and bottom container portions 130, 170 respectively during a blow-molding process. In contrast to the container 10 of the first embodiment of the disclosure wherein the middle portion 50 and bottom portion have circular lateral cross sections, the middle portion 50 and bottom portion of 70 container 110 comprise substantially rectangular cross sections. The lateral cross section of the middle container portion 150 is shown in FIG. 15. The middle portion 150 and bottom portion 170 define a container with a rectangular body. The rectangular configuration of container 110 is shown in FIGS. 11, 13 and 14. In the illustrated embodiments shown in FIGS. 11, 13 and 14, the container has a square configuration.

The top container portion 130 comprised of a frusto-pyramidal configuration with a substantially rectangular lower end where the top container portion 130 is made integral with the middle container portion 150. The top container portion terminates at the upper end at opening 16. Top strut members 32 previously described in conjunction with the first embodiment container 10, are also included along the top container portion 130 of the second embodiment container 110. Each pair of adjacent top struts 32 are separated by a recess 34. Handle 18 and recess 19 are included in the top container portion 130.

As shown in FIG. 13, top portion struts 32 are located at positions identified at 136*a*, 136*b* and 136*c*, with each of the adjacent positions along top container portion 130 being separated by approximately ninety degrees. Top container position identified as 136*d* does not include a top strut 32. Recess 19 and handle 18 are positioned at 136*d*. A discrete strut member 33 may be provided along the recess 19. The strut extends between the ends of the handle 18 where the handle is made integral with the top container portion 130.

The middle container section 150 includes a plurality of spaced ribs 154, with each of the ribs being separated from each longitudinally adjacent rib by grooves 56 as previously described. Each of the ribs 154 comprises a substantially rectangular perimeter. As shown in FIG. 15, the middle container section 150 comprises middle container positions 156*a*, 156*b*, 156*c* and 156*d*. The positions 156*a*, 156*b*, 156*c*, and 156*d* are separated by about ninety degrees and align with respective positions 136*a*, 136*b*, 136*c*, and 136*d* of the top container portion 130. Additional strut members 32 are provided between the struts located at pairs of adjacent top container positions 136*a*, 136*b*, and 136*c*. As best illustrated in FIG. 13, a strut 32 is provided between positions 136*c*, 136*b*; and between positions 136*b*, 136*a*

Middle strut members 52 as previously described are located in each of the grooves 56. The middle strut members 52 of adjacent grooves 56 are disposed in the same lateral position within each groove 56 and as a result are aligned longitudinally. For example, as shown in FIG. 11, ribs 154 are longitudinally aligned at middle container positions 156*c* and 156*d* of the container 110. Similarly, ribs 154 are longitudinally aligned at middle container positions 156*b* and 156*a*. Additionally, between each pair of adjacent positions along middle container portion 150, a plurality of adjacent ribs 154 are also provided As shown in FIG. 11, a plurality of ribs 154 are shown longitudinally aligned between positions 156*c* and 156*d*. Similar arrangements of longitudinally aligned ribs 154 are provided between positions 156*c*, 156*b*; between positions 156*b*, 156*a*; and between positions 156*a*, 156*d*.

The bottom container portion 170 is shown in FIG. 14, and includes bottom container positions 176*a*, 176*b*, 176*c* and 176*d*. The bottom container positions are separated by approximately ninety degrees. Bottom container position 176*a*, is in longitudinal alignment with middle container position 156*a* and top container position 136*a*. Bottom container position 176*b* is in longitudinal alignment with middle container position 156*b* and top container position 136*b*. Bottom container position 176*c*, is in longitudinal alignment with middle container position 156*c* and top container position 136*c*. Bottom container position 176*d*, is in longitudinal alignment with middle container position 156*d* and top container position 136*d*.

The bottom container portion includes bottom strut members 72 at each of the bottom portion positions 176*a*, 176*b*, 176*c* and 176*d*. Additionally, bottom strut members 72 are provided along the bottom portion 170 between adjacent bottom portion positions. As shown in FIG. 14, bottom strut members 72 are located between the bottom struts 72 at positions 176*a* and 176*b*; between the bottom struts at positions 176*b* and 176*c*; between the bottom struts at positions 176*c* and 176*d*; and between the bottom struts at positions 176*d* and 176*a*. Each pair of adjacent struts is separated by a recessed portion 74, as previously described.

Support columns 20*a*, are provided at the aligned positions of the collective longitudinally aligned top, middle and bottom container portions at (136*a*, 156*a*, 176*a*); (136*b*, 156*b*, 176*b*) and (136*c*, 156*c*, 176*c*). Support columns 20*b* are provided at longitudinally aligned positions 156*d* and 176*d*, and adjacent the aligned positions 156*d*, 176 of the respective middle and bottom portions 150 and 170.

Similar to the container 10 as previously described, the combination of the recesses 74, 34 and 35 as well as grooves 56 yield a container 110 that may be up to 15% lighter than a container having similar volume. The first support columns 20*a*, and second support columns 20*b* of the container 110 enable the container to resist deformation during transportation and shipment.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A plastic container comprising:

a top container portion including a plurality of spaced top strut members;

a bottom container portion including a plurality of spaced bottom strut members; and, a middle container portion located between the top and bottom container portions, the top, bottom and middle container portions oriented along a container axis; the middle container portion comprising:

a plurality of annular rib members, wherein each rib member is separated from longitudinally adjacent rib members by an annular groove, each groove having a number of middle strut members disposed along a length of the groove, wherein the rib members have a diameter that is less than a diameter of the top container portion adjacent the middle container portion; and, adjacent middle strut members of adjacent grooves being longitudinally aligned;

wherein the container comprises a plurality of first columns comprised collectively of a top strut member of the plurality of spaced top strut members, a first set of middle strut members of the number of middle strut members and a bottom strut member of the plurality of spaced bottom strut members, the top strut member, first set of middle strut members and bottom strut member comprising each of the first columns are longitudinally aligned.

2. The container of claim 1 further comprising a plurality of second columns, each column of the plurality of second columns is comprised collectively of a second set of middle strut members and a bottom strut member, wherein the second set of middle strut members and bottom strut member of each second column are longitudinally aligned.

3. The container of claim 1, wherein each top strut member of the plurality of spaced top strut members comprises a first end, and a second end, wherein a width of the each top strut member increases as the strut extends from the first end to the second end.

4. The container of claim 3, wherein the top portion includes an opening, wherein the first end of the each top strut member is located proximate the container opening and the second end of the each top strut member being located proximate the middle container portion, and wherein the top container portion includes a handle extending therefrom.

5. The container of claim 1, further comprising an annular upper shoulder that provides a transition from the relatively larger diameter of the top container portion to the reduced diameter of the plurality of rib members, wherein the each top strut member is separated from an adjacent top strut member by a recessed portion.

6. The container of claim 1, wherein each groove is U-shaped and includes eight middle strut members disposed in each groove.

7. The container of claim 1, wherein each of the bottom strut members is separated from an adjacent bottom strut member by a bottom portion recessed portion.

8. The container of claim 1, wherein each bottom strut has a thickness.

9. The container of claim 1, wherein the container has a volume in the range of 0.5 gallons (1.89 liters) to two gallons (7.57 liters).

10. The container of claim 1, wherein the middle portion has a circular cross-section.

11. The container of claim 1, wherein the middle portion has a rounded cross-section.

12. The container of claim 1 further comprising a number of spaced container positions, and a support column being located at each position.

13. The container of claim 12, further comprising four container positions, wherein three of the first support columns are located at each of three of the container positions, and wherein additional first support columns of the first support columns being located between adjacent support columns of the first support columns at adjacent container positions of the spaced container positions.

14. The container of claim 12, further comprising four container positions, wherein the container includes at least one of the first support columns located at at least one of the spaced container positions and a second support column located at one other of the spaced container positions.

15. A plastic container comprising:

a top container portion including a plurality of spaced apart top strut members;

a bottom container portion including a plurality of spaced bottom strut members; and, a middle container portion located between the top and bottom container portions, the top, bottom and middle container portions oriented along a container axis; the middle container portion comprising:

a plurality of annular rib members, wherein each rib member is separated from longitudinally adjacent rib members by an annular groove, each groove having a number of middle strut members disposed along a length of the groove, wherein the plurality of annular rib members have a diameter that is less than a diameter of the bottom container portion adjacent the middle container portion; and, adjacent middle strut members of adjacent grooves being longitudinally aligned;

wherein the container comprises a plurality of first columns comprised collectively of a top strut member of the plurality of spaced top strut members, a first set of middle strut members of the number middle strut members and a bottom strut member of the plurality of spaced bottom strut members, the top strut member, first set of middle strut members and bottom strut member comprising each of the first columns are longitudinally aligned.

16. The container of claim 15, wherein the top portion includes an opening, wherein a first end of a top strut member of the plurality of spaced apart top strut members is located proximate the container opening and a second end of the top strut member is located proximate the middle container portion, and wherein the top container portion includes a handle extending therefrom.

17. The container of claim 15, further comprising an annular lower shoulder that provides a transition from the relatively larger diameter of the bottom container portion to the reduced diameter of the plurality of annular rib members, wherein each top strut member of the plurality of spaced apart top strut members is separated from an adjacent top strut member by a recessed portion.

18. The container of claim 15, wherein each top strut member of the plurality of spaced apart top strut members comprises a first end and a second end, wherein a width of the each top strut member increases as the strut extends from the first end to the second end.

* * * * *